US006100642A

United States Patent [19]

Kim

[11] Patent Number: 6,100,642

[45] Date of Patent: Aug. 8, 2000

[54] DISCHARGE LAMP OPERATING ELECTRONIC DEVICE FOR IMPROVING THE RELIABILITY, EFFICIENCY, AND LIFE OF A HOT-CATHODE DISCHARGE LAMP

[75] Inventor: Jong Ki Kim, Busan, Rep. of Korea

[73] Assignee: Kabushiki Kaisha Koseijapan, Fukuoka-Ken, Japan

[21] Appl. No.: 09/091,519

[22] PCT Filed: Dec. 19, 1995

[86] PCT No.: PCT/JP95/02608

§ 371 Date: Feb. 23, 1999

§ 102(e) Date: Feb. 23, 1999

[87] PCT Pub. No.: WO97/23119

PCT Pub. Date: Jun. 26, 1997

[51] Int. Cl.[7] ..... H05B 37/02

[52] U.S. Cl. ..... 315/205; 315/219; 315/224; 315/DIG. 5

[58] Field of Search ..... 315/209 R, 219, 315/224, 291, DIG. 5, 205

[56] References Cited

FOREIGN PATENT DOCUMENTS 63-175394 7/1988 Japan .
1-143191 6/1989 Japan .
4-73893 3/1992 Japan .
4-285474 10/1992 Japan .
4-296495 10/1992 Japan .

*Primary Examiner*—David Vu
*Attorney, Agent, or Firm*—Wenderoth, Lind & Ponack, L.L.P.

[57] ABSTRACT

A discharge lamp operating electronic device is provided with a booster circuit for converting the direct-current power provided by a direct-current power supply to a predetermined operating voltage, a self-excitatory inverter for converting the operating voltage provided by the booster circuit to predetermined high frequency, a lamp operating circuit for converting the high-frequency output from the self-excitatory inverter into sine waves to light a discharge lamp, an overload protective circuit for stopping an operation of the self-excitatory inverter circuit when an overload occurs in the lamp operating circuit. The operating efficiency of the filament of a hot-cathode discharge lamp is improved by alternately heating a thermionic discharge path from four points of the filament, and the voltage at the filament can be easily adjusted. Two or more hot-cathode discharge lamps can be connected in parallel and even when one or more hot-cathode discharge lamps are removed, the remaining hot-cathode discharge lamps can be operated without problems, whereby the life of the discharge lamps is prolonged and the energy consumption is lowered.

10 Claims, 5 Drawing Sheets

DISCHARGE LAMP OPERATING ELECTRONIC DEVICE FOR IMPROVING THE RELIABILITY, EFFICIENCY, AND LIFE OF A HOT-CATHODE DISCHARGE LAMP

FIELD OF THE INVENTION

The present invention relates to an electronic device for operating a discharge lamp by converting a frequency of commercial electric power to a high frequency and turning on the lamp using the high frequency, wherein by dispersing the power at the high frequency through a discharge path of a filament, the operating efficiency of the discharge lamp is maximized, the service life of the lamp is also prolonged, and a substantial energy saving can be realized.

BACKGROUND OF THE INVENTION

A conventional inverter comprises two switches S1 and S2, two power supplies E1 and E2 and a LC series circuit consisting of reactor L1 and capacitor C2 which is connected between a junction point of the two switches S1 and S2 and a junction point of the two power supplies E1 and E2 as is indicated in FIG. 2. When the switch S1 is on and the switch S2 is off, current iL flows in a direction indicated by the arrow through the LC series circuit. On the contrary, when the switch S1 is off and the switch S2 is on, the current iL flows in an opposite direction through the LC series circuit.

By turning on and off the switches S1 and S2 alternately, the direction of the current flowing through the LC series circuit can be continuously changed. Thus, when the switches are turned on and off at a speed T=1/Fo which is approximate to an intrinsic resonance frequency (see the following Expression 1) of the LC series circuit, a voltage VL1 (see the following Expression 2) is generated across the reactor L1 while voltage VC1 (see the following Expression 2) is generated across the capacitor C1.

$$Fo=\tfrac{1}{2\pi}\sqrt{LC} \qquad \text{(Expression 1)}$$

$$VL1=Ldi/dt,\ VC1=1/C\times\int idt \qquad \text{(Expression 2)}$$

FIG. 1 shows a circuit of a discharge lamp operating device employing a self-excited inverter, to which the above principle is applied, reconstructing the circuit in FIG. 2. The circuit in FIG. 1 is provided with semiconductor devices, that is transistors Q1 and Q2, for use in place of switches S1 and S2. Instead of the power supplies E1 and E2 of the circuit in FIG. 2, the circuit in FIG. 1 has an operating power supply E for supplying power from the outside, and capacitors C2 and C3 for storing power are connected to perform the same function as the power supplies E1 and E2 respectively. Thus, the circuit in FIG. 1 is configured to be equivalent to the circuit in FIG. 2. In order to turn on and off the transistors Q1 and Q2 alternately, an oscillation transformer T1 is inserted between a junction point of the transistors Q1 and Q2 and the reactor L1, and secondary side coils of the oscillation transformer T1 are connected between a base and an emitter of the transistors Q1 and Q2, respectively, in such a way that directions of induction of voltages in the secondary side coils oppose each other.

When an actuating signal is supplied to the transistor Q2 in FIG. 1, the transistor Q2 is turned on and a current iL starts flowing in a direction opposite to that indicated by the arrow. If a voltage induced to the secondary side of the oscillation transformer T1 turns off the transistor Q1 and sufficiently turns on the transistor Q2 and the oscillation transformer T1 becomes saturated, then the directions of induction of the voltages in the secondary side coils of the transformer TI are reversed. By turning on the transistor Q1 and turning off the transistor Q2, the current iL starts flowing in a direction indicated by the arrow in FIG. 1. When the oscillation transformer T1 becomes saturated, the directions of induction of the voltages in the secondary side coils of the oscillation transformer T1 are reversed and then the transistor Q1 is turned off and the transistor Q2 is turned on. This operation is repeated in a self-excitatory (self-excited) manner without supplying any external signals, at which time a voltage represented by the following expression 3 is generated across capacitor C1.

$$VC1=1/C\times\int idt \qquad \text{(Expression 3)}$$

In the circuit described in FIG. 1, a hot-cathode discharge lamp LA is connected across the capacitor C1 so that a voltage generated across the capacitor C1 is transferred to the hot-cathode discharge lamp LA to operate the hot-cathode discharge lamp LA. The configuration of the circuit in FIG. 1 is common to the conventional hot-cathode discharge lamp operating devices employing a self-excitatory inverter.

In a hot-cathode discharge lamp operating device employing a conventional self-excitatory inverter, all of the current running from the LC series resonance circuit to the capacitor flows through filaments on both sides of the hot-cathode discharge lamp and, therefore, a filament heating voltage Vf is represented as Rf×iL provided that the filament's internal resistance is Rf. Thus, as the filament heating voltage Vf varies according to the current running through the capacitor of the LC series resonance circuit, the filament heating voltage Vf cannot be appropriately adjusted and as a result, thermal electrons are emitted through only one or two points within the hot-cathode discharge lamp, where intense heat is produced. Thus, shortening the lifetime of the filaments.

Further, according to the prior art, when a supply voltage varies, the output frequency also varies and a scope of change in high-frequency output expands and, thereby, the voltage across the capacitor C1 of the LC resonance circuit changes, which changes the illuminance of the lamp. Therefore, it is difficult to supply the preheat voltage to the filament at an initial stage of lighting the lamp. It is also difficult to construct a control circuit for dealing with the terminal phenomenon of the hot-cathode discharge lamp. Thus, the operating efficiency of the hot-cathode discharge lamp deteriorates, and the reliability of a discharge lamp operating device is compromised.

Given the above, it is the object of the present invention to obviate the aforementioned problems of the prior art and to provide a discharge lamp operating electronic device which enables a prolonged service life of the hot-cathode discharge lamp and provides improved reliability of the operating device.

SUMMARY OF THE INVENTION

The present invention pertains to a discharge lamp operating electronic device, wherein immediately after direct-current power has been supplied to a booster circuit, an initial voltage which is not high enough to operate or light a hot-cathode discharge lamp is supplied to a self-excitatory inverter to thereby preheat a filament. For a predetermined period of time, the voltage gradually increases to a level where it can operate the hot-cathode discharge lamp and after the predetermined period of time has passed, a constant voltage is supplied to the self-excitatory inverter. When the life of the hot-cathode discharge lamp reaches a terminal stage, the circuit is substantially broken.

A discharge lamp operating electronic device of the present invention includes an overload protective circuit to improve reliability characterized in that a thermionic discharge path is heated by alternating through four points on the filament of the hot-cathode discharge lamp, thereby improving the operating efficiency of the filament. Two or more hot-cathode discharge lamps having such a configuration allowing for easy adjustment of the filament voltage can be connected in parallel, so that when one or more of the hot-cathode discharge lamps connected in parallel is removed, operation of the remaining discharge lamps is not affected.

A discharge lamp operating electronic device of the present invention is also characterized by comprising:

a booster circuit which supplies a low operating voltage to the self-excitatory inverter at the initial stage of supplying power to preheat the filament of the discharge lamp, then gradually increases the operating voltage supplied to the self-excitatory inverter for a predetermined period of time to, thereby, operate or light the discharge lamp at low voltage and further supplies a constant voltage after the predetermined period of time has passed, thereby stabilizing the operation of the self-excitatory inverter;

an actuating signal circuit for supplying an actuating signal to the self-excitatory inverter at the initial stage of supplying power and stops supplying the actuating signal after a cycle of an operation of the self-excitatory inverter;

the self-excitatory inverter for converting a frequency of the operating voltage provided by the booster circuit to a high frequency and sending it to a lamp operating circuit; and the lamp operating circuit for converting the high-frequency output from the self-excitatory inverter into sine waves to operate the discharge lamp, wherein a filament of the discharge lamp emits thermal electrons which alternate through four thermionic emission paths at the time of lighting of the lamp.

A discharge lamp operating electronic device of the present invention is further characterized by comprising:

a direct-current power supply for outputting direct-current power obtained by rectifying an alternating-current input voltage;

booster circuit for converting the direct-current power provided by the direct-current power supply to a predetermined operating voltage;

a self-excitatory inverter for converting the operating voltage supplied from the booster circuit to a predetermined high frequency; and a lamp operating circuit for converting the high-frequency output from the self-excitatory inverter to sine waves to operate the discharge lamp.

A discharge lamp operating electronic device of the present invention is further characterized by comprising:

a direct-current power supply for outputting direct-current power obtained by rectifying an alternating-current input voltage;

a booster circuit for converting the direct-current power provided by the direct-current power supply to a predetermined operating voltage;

a self-excitatory inverter for converting the operating voltage supplied from the booster circuit to a predetermined high frequency;

a lamp operating circuit for converting the high-frequency output from the self-excitatory inverter into sine waves to operate the discharge lamp; and an overload protective circuit for stopping an operation of the self-excitatory inverter circuit when an overload occurs in the lamp operating circuit.

A discharge lamp operating electronic device of the present invention characterized in that the booster circuit comprises sensing means for sensing a change in the direct-current power which varies in proportion to a change in the alternating-current input voltage and adjusting means (control means) for adjusting an operating voltage supplied to the self-excitatory inverter on the basis of an output from the sensor for the operating voltage is a constant voltage.

A discharge lamp operating electronic device of the present invention characterized in that the booster circuit comprises a reactor connected to the direct-current power supply to accumulate a voltage from the direct-current power supply and to transmit the accumulated voltage; and a transistor connected to the reactor to control the accumulation of voltage in the reactor and the transmission of voltage from the reactor.

A discharge lamp operating electronic device of the present invention is characterized in that the lamp operating circuit is configured in such a way that a filament of a hot-cathode discharge lamp emits thermal electrons which alternate through four thermionic emission paths.

A discharge lamp operating electronic device of the present invention is characterized in that two or more lamp operating circuits can be connected in parallel and the hot-cathode discharge lamps are, respectively, connected to the lamp operating circuits, wherein when the hot-cathode discharge lamp connected to the lamp operating circuit is removed, the lamp operating circuit has an infinite impedance and the lamp operating circuit from which the hot-cathode discharge lamp is removed, it is separated from the circuit. Removal of one or more of the multiple hot-cathode discharge lamps connected in parallel will not affect the operation of the remaining hot-cathode discharge lamps.

Having the aforementioned structure, a device of the present invention supplies a low operating voltage to a self-excitatory inverter to preheat a filament of a discharge lamp at the initial stage of power supply by operation of a booster circuit for supplying operating power to the self-excitatory inverter. The booster circuit gradually increases the operating voltage of the self-excitatory inverter for a predetermined period of time to a level where the booster circuit can operate the discharge lamp at low voltage and then supplies a constant voltage to the self-excitatory inverter after the predetermined period of time has passed, thereby stabilizing the operation of the self-excitatory inverter.

Further, given the aforementioned structure, the actuating signal circuit of the present device operates at the initial stage of power supply to supply an actuating signal to the self-excitatory inverter and stops supplying the actuating signal after the self-excitatory inverter has accomplished a cycle of operation. The self-excitatory inverter converts the operating voltage supplied from the booster circuit to a high frequency and sends the high frequency to the lamp operating circuit. Further, the lamp operating circuit converts the high-frequency output from the self-excitatory inverter into sine waves to operate the discharge lamp. At this time, the filament of the discharge lamp emits thermal electrons which alternate through four emission paths.

DETAILED DESCRIPTION OF THE INVENTION

Figure 1:
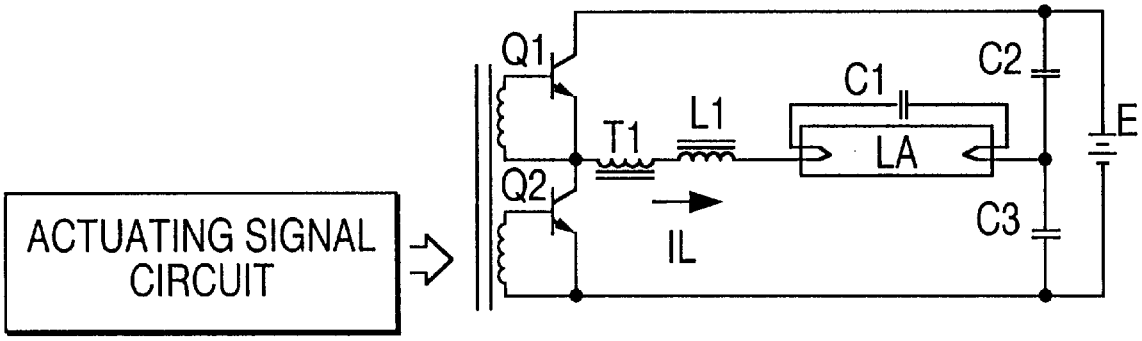
FIG. 1 (PRIOR ART)
FIG. 1 is a circuit diagram describing a discharge lamp operating device employing a conventional self-excitatory inverter.
Figure 2:
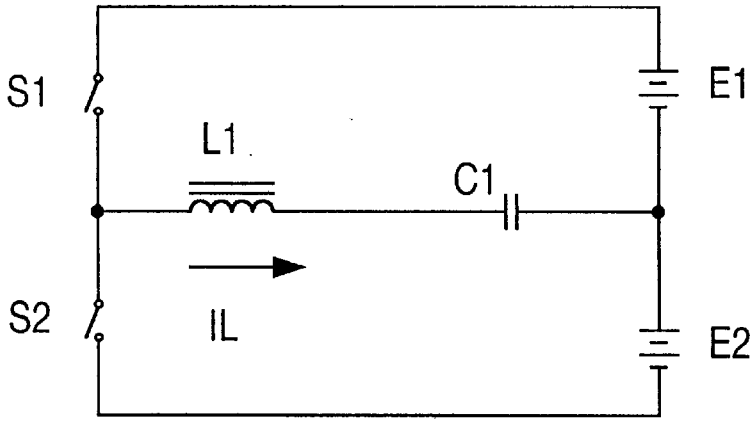
FIG. 2 (PRIOR ART)
FIG. 2 is a circuit diagram describing a conventional inverter.
Figure 3:
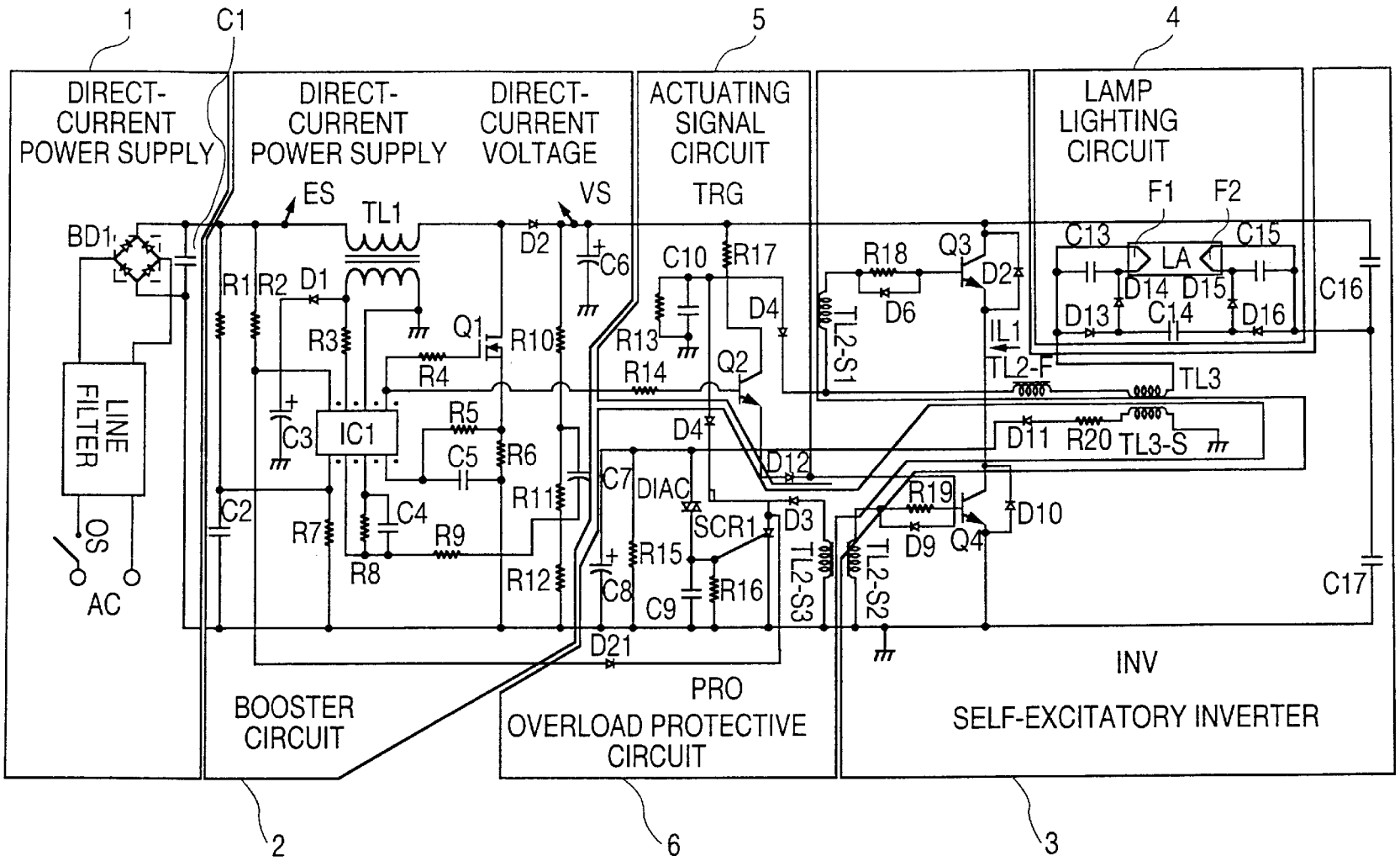
FIG. 3 is a circuit diagram indicating a discharge lamp operating device according to an embodiment of the present invention.

Hereafter, embodiments of the present invention will be explained by way of the attached drawings. FIG. 3 is a circuit diagram showing a discharge lamp operating device.

A direct-current power supply 1 of FIG. 3 comprises the following elements. AC denotes a commercial alternating-current power supply and SO denotes a switch. Further in the drawing, a component indicated as LINE FILTER is a power supply noise removing filter; BDI is a rectifying bridge diode; and C1 is a waveform shaping capacitor.

A booster circuit 2 of FIG. 3 comprises the following elements. A component indicated as IC1 is an integrated circuit. Further, R9, R10, R11 and R12 denote operating voltage detecting sensor resistors; C7 is a charging time constant capacitor; R8 is a signal amplifying resistor; C4 is a high-frequency bypass capacitor; TL1 is a reactor; Q1 is a field-effect transistor; R4 is a gate resistor; R6 is a current detecting resistor; R5 is a signal attenuation resistor; C5 is a high-frequency bypass capacitor; R2 is an initial power supply resistor; C3 is a smoothing capacitor; R1 and R7 denote operating reference voltage supply resistors; C2 is a high-frequency signal bypass capacitor; D1 is a rectifying capacitor; R3 is a signal supply resistor; D2 is a high-frequency rectifying diode; and C6 is a smoothing capacitor.

The following elements, comprise a self-excitatory inverter INV of FIG. 3. Q3 and Q4 denote high-frequency output transistors; C16 and C17 are power storing capacitors; D7 and D10 are transistor protection diodes; R18 and R19 are base resistors; D6 and D9 are speed up diodes; TL2-F is a primary side coil (winding) of a resonance current detecting transformer; TL2-S1 and TL2-S2 are secondary side coils of the resonance current detecting transformer; and TL3 is a resonance reactor.

The following elements and others constitute the lamp lighting circuit indicated by the numeral 4 of FIG. 3. C13 and C15 denote filament heating voltage control capacitors; C14 is a resonance capacitor; D13, D14, D15, D16 are filament thermionic emission path dispersing diodes; and LA a hot-cathode discharge lamp.

An actuating signal circuit TRG indicated by the numeral 5 of FIG. 3 comprises the following elements. Q2 denotes an actuating signal transistor; R14 is a base resistor; R13 and R17 are charging time constant resistors; C10 is a charging time constant capacitor; D4 is a recharging prevention diode; and D12 is a reverse voltage prevention diode.

The elements below and others constitute an overload protective circuit PRO indicated by the numeral 6 in FIG. 3. TL2-S3 denotes a secondary side coil of the resonance current detection transformer TL2-F; D3 and D11 are high-frequency rectifying diodes; SCR1 is a thyristor; R16 is a gate resistor; C9 is a gate capacitor; DIAC1 is a diode AC switch; R20 and R15 are voltage detecting sensor resistors; C8 is a time constant capacitor; TL3-S is a secondary side coil of the reactor TL3; and D21 is an operation power supply breaking (blocking) diode.

Next, an operation of each circuit comprising the aforementioned elements will be explained. First, in the direct-current power supply 1, when the switch SO is turned on, a commercial alternating-current power AC passes through the line filter to be supplied to an input side of the bridge diode BD1, while an output from the direct-current power supply 1, ES is obtained across an output side of the bridge diode BD. The direct-current power ES is supplied to the booster circuit 2.

Figure 8:
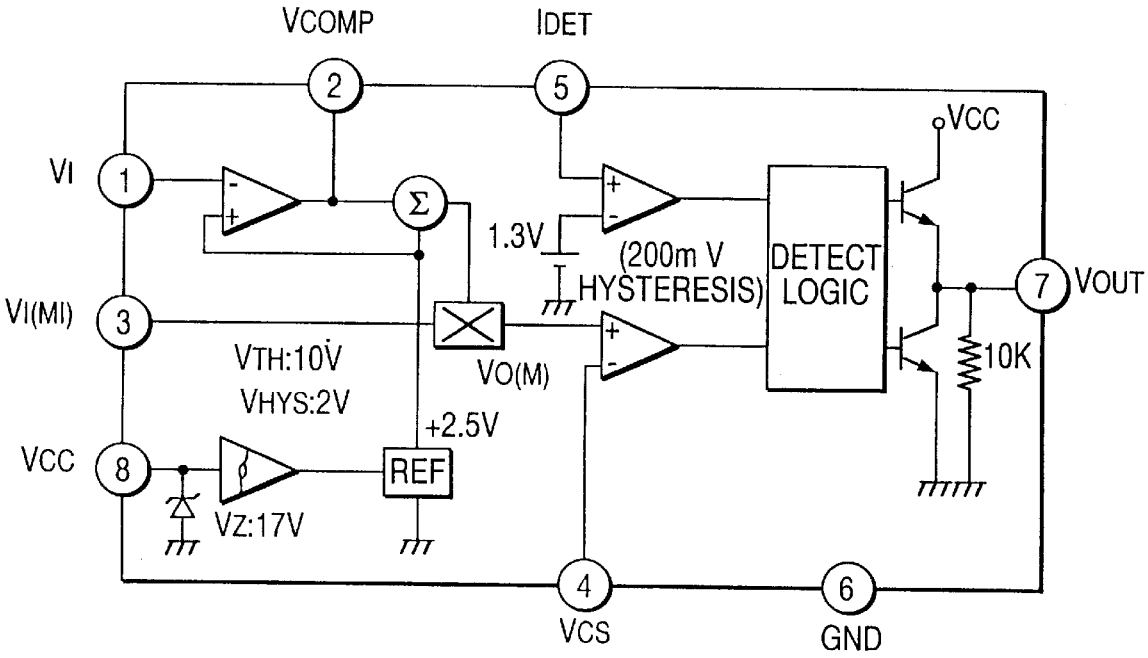
FIG. 8 is a block diagram of the integrated circuit IC1 in FIG. 3.

In the booster circuit 2, the current passes through the reactor TL1 to supply voltage across a drain and source of the field effect transistor Q1. At the same time, an operating reference voltage V1 (M1) is supplied from the resistors R1 and R7 to a third pin (PIN) of the integrated circuit IC1, whereas charging of the capacitor C3 starts at a time constant determined by the resistor R2 and the capacitor C3 connected to an eighth pin of the integrated circuit IC1. Also at the same time, a preset voltage represented by the following expression 4 passes through the resistor R9 to be supplied as a preset voltage V1 signal to a first pin of the integrated circuit IC1 by the resistors R10, R11, R12 and the capacitor C7. However, at the initial stage of supplying power, the capacitor C7 is charged at a time constant determined by the capacitor C7 and resistor R11. Thus, the preset voltage V1 gradually decreases from R12/(R10+R12) to R12/(R10+R11+R12). The integrated circuit IC1 is a PFC (power factor correction) IC, the inside of which is described in the block diagram of FIG. 8.

$$V1 \approx R11 \times R12) \times VS/(R10+R11+R12) \quad \text{(Expression 4)}$$

Further in the booster circuit 2, the capacitor C3 connected to the eighth pin of the integrated circuit IC1 is charged. When the capacitor C3 is charged up to an operating voltage VCC, an operating voltage of the integrated circuit IC1, an internal circuit of the integrated circuit IC1 starts operating, whereby a pulse output signal is outputted to the seventh pin VOUT of the integrated circuit IC1. The pulse output signal passes through the resistor R4 and is supplied as a gate pulse signal to a gate of the field effect transistor Q1. When the gate pulse signal is inputted, the field-effect transistor Q1 is turned on. After energy has been stored in the reactor TL1, the transistor Q1 is turned off. When the field-effect transistor Q1 enters the off state, the energy stored in the reactor TL1 passes through the diode D2 to be rectified. The energy is further smoothed by the capacitor C6 and a direct-current voltage VS is supplied to the self-excitatory inverter 3.

In the self-excitatory inverter 3, the energy is stored in the reactor TL2 and a voltage is induced across the secondary side coils TL2-S1 and TL2-S2 of the reactor TL2. The induced voltage is rectified by the diode D1 and smoothed by the capacitor C3 to be supplied to the operating voltage VCC of the integrated circuit IC1. It is further supplied as an IDET signal to a fifth pin of the integrated circuit IC1 via the resistor R3.

When the field-effect transistor Q1 is turned on and current starts running, a voltage is generated across the current sensor resistor R6. A thus generated voltage is supplied as a VCS signal to a fourth pin of the integrated circuit IC1 via the resistor R5.

When signals indicated in characteristic data of the integrated circuit IC1 in Table 1 enter each pin of IC1, the internal circuit of the integrated circuit IC1 starts operating to sense a change in the direct-current power ES and to adjust a ratio between on and off of the field-effect transistor Q1 so that the DC voltage VS becomes a constant voltage. More specifically, in the present embodiment, the direct-current power ES is obtained by full-wave rectifying the alternating-current input voltage and the direct-current voltage VS is an operating voltage supplied to the self-excitatory inverter 3. By sensing a change in the direct-current power ES which varies in proportion to a change in the alternating-current input voltage and adjusting the ratio between on and off of the field-effect transistor Q1, the direct-current voltage VS which is an operating voltage of the self-excitatory inverter is controlled, becoming a constant voltage.

The voltage varies in inverse proportion to the preset voltage V1 of the integrated circuit IC1 due to the resistors R10, R11 and R12.

At the initial stage of supplying the direct current power ES, the preset voltage V1 of the integrated circuit IC1 gradually decreases during charging at a time constant determined by the capacitor C7 and resistor R11, while the direct-current voltage VS is gradually increased. When charging of the capacitor C7 has been completed, a constant voltage proportioned to the preset voltage V1=R12/(R10+R11+R12) is supplied as the direct-current voltage VS to the self-excitatory inverter 3.

Next, when the switch SO is turned on, the direct-current power VS is supplied to the actuating signal circuit TRG 5 via the reactor TL 1 and the rectifying diode D2 and charging of the capacitor C10 begins at a time constant determined by the resistors R13 and R17 and capacitor C10. After the capacitor C10 has been charged up to a voltage set by the resistors R17 and R13, the integrated circuit IC1 in the booster circuit 2 operates and an output signal passes from the integrated circuit IC1 through the base resistor R14 to be supplied to the actuating signal transistor Q2. Thereby, the transistor Q2 is turned on and at the same time, a voltage fed to capacitor C10 is supplied to a base of the high-frequency output transistor Q4 in the self-excitatory inverter 3 via a collector of the actuating signal transistor Q2 and the diode D12, whereby the transistor Q4 is turned on.

When the high-frequency output transistor Q4 is turned on in the self-excitatory inverter 3, the direct current power ES is supplied and at the same time, the power storing capacitors C16 and C17 are charged. By the charged voltage, a closed circuit is formed, in which iL1 current flows from the capacitor C17 to a collector of the transistor Q4 via the filament thermionic emission path dispersing diode D16, the resonance capacitor C14, the filament thermionic emission path dispersing diode D14, the filament F1 of the hot-cathode discharge lamp LA in the lamp operating circuit 4, the resonance reactor TL3 and the primary side coil TL2-F of the resonance current detection transformer TL2.

At this time, voltages of the secondary side coils TL2-S1 and TL2-S2 of the resonance current detection transistor TL2 are induced opposing voltages. Thereby, when the transistor Q4 is turned completely on, the transistor Q3 is turned off.

When the transistor Q4 is turned completely on and the iL1 current flows sufficiently to saturate the resonance reactor TL3, the current iL1 starts gradually decreasing. At this time, the voltages induced to the secondary side coils TL2-S1 and TL2-S2 of the resonance current detection transformer TL2 are reversed, so that the transistor Q4 is turned off and the transistor Q3 is turned on. As a result of the voltage stored in the power storing capacitor C16 in the lamp operating circuit 4, current starts flowing toward the iL2 direction via capacitor C16, transistor Q3, primary side coil TL2-F of the oscillation current detection transformer, reactor TL3, thermionic emission path dispersing diode D13, capacitor C14, thermionic emission path dispersing diode D15 and filament F2 (see FIG. 4). When the iL2 current sufficiently flows, the resonance reactor TL3 becomes saturated and the iL2 current starts gradually decreasing. At this time, the voltages induced to the secondary side coils TL2-S1 and TL2-S2 of the resonance current detection transformer TL2 are reversed again. Thus, the transistor Q4 is turned on and the transistor Q3 is turned off. The self-excitatory inverter 3 repeats the aforementioned operation in a self-excitatory manner.

When the high-frequency output transistor Q4 is turned on, the voltage fed to the capacitor C10 is discharged from the actuating signal circuit TRG 4 via the diode D4. Then, a working speed of the self-excitatory inverter becomes much faster than the time constant for recharging the resistors R13, R17 and capacitor C10, while time for discharging via the transistor Q4 becomes shorter than the time for charging. Thus, the capacitor C10 cannot be recharged, and after one cycle of operation by the self-excitatory inverter 3, the actuating signal circuit TRG 5 stops operating.

Figure 4:
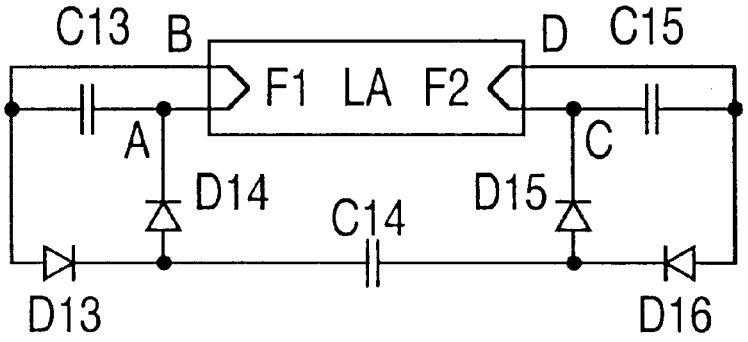
FIG. 4 is a diagram showing a lamp operating circuit of the embodiment.

Next, the details of an operation of the lamp operating circuit 4 connected to a high-frequency output terminal of the self-excitatory inverter will be explained by way of the circuit diagram in FIG. 4. In FIG. 4, when the high-frequency output transistors Q3 and Q4 in the self-excitatory inverter are turned off and on, respectively, the current iL1 starts flowing, as a result of the voltage stored in the capacitor C17, through the capacitor C17, the diode D16, the capacitor C14, the diode D14, the filament Fl, the transformer TL3 and the transistor Q4. Then, a voltage VFAB=F1×iL1 is generated across the filament F1, whereby the filament F1 is heated.

At this time, due to the voltage VFCD across the filament F2, the current iL 1 attempts to flow from the capacitor C17 to the filament F2 and further to the capacitor C14 via the diode D15. However, since the diode D15 is connected in the direction opposite to the flow of the current iL1, the current iL1 cannot flow through the diode D15. Therefore, as there is no current flowing through the filament F2, the voltage VFCD across the filament F2, becomes practically zero.

On the other hand, thermionic emission from the filament of the hot-cathode discharge lamp LA occurs through an emission path having the highest potential difference. Voltages applied between the respective filament pole points are represented by the following expressions 5.

$$① VAB \approx iL1 \times F1 \quad \text{(Expression 5)}$$

$$② VAC \approx VC$$

$$③ VAD \approx VC$$

$$④ VBC \approx VC + iL1 \times F1$$

$$⑤ VBD \approx VC + iL1 \times F1$$

$$⑥ VCD \approx 0$$

Thus, as there is a phase difference of 90° between VC and iC of the capacitor C14, maximum potentials are VBC and VBD when iC×VC is greater than zero. At this time, a potential difference between the ends of VCD is "0" and thermionic emission is conducted by dispersing thermal electrons from a pole point B toward the whole of the filament F2. On the other hand, when iC×VC is less than zero, maximum potentials are VAC and VAD and thermal electrons are dispersed from a pole A to the filament F2.

On the contrary, when the output transistors Q3 and Q4 in the self-excitatory inverter 3 are turned on and off, respectively, the current iL2 flows through the transistor Q3 to the diode D13, the capacitor 14, the diode D15, the filament F2 due to the voltage stored in the power storing capacitor C16. Thus, a voltage VFCD=FCD×iL2 is generated across the filament F2, whereby the filament F2 is heated. At this time, the iL2 current attempts to flow to the capacitor C14 through the transformer TL3, the filament F1 and the diode D14 due to the voltage VFAB across the filament F1. However, since diode D14 is connected in the direction opposite to the flow of the current iL2, the current iL2 cannot flow through the diode D14. Thus, as there is no current to flow through the filament F1, the voltage VFAB across the filament F1 becomes practically zero.

On the contrary, thermionic emission in the filaments of the hot-cathode discharge lamp LA occurs through a discharge path having the highest potential difference. At this time, the voltages applied between the respective filament pole points are as represented by the following expressions 6.

(Expression 6)

① VAB=0

② VAC≈VC

③ VAD≈VC+iL2×F2

④ VBC≈VC

⑤ VBD≈VC+iL2×F2

⑥ VCD≈iL2×F2

Thus, there is a phase difference of 90° between VC and iC of the capacitor C14. When iC×VC is greater than zero, maximum potentials are VAD and VBD. On the other hand, when iC×VC is less than zero, maximum potentials are VAC and VBC.

Since VAB is equal to zero, thermionic emission from a pole point D is dispersed substantially to F1. However, if the phase of C14 is reversed, thermionic emission from a pole point C is dispersed to F1. As is clear from the expressions 5 and 6, during a cycle of an operation of the self-excitatory inverter 3, the hot-cathode discharge lamp LA has four discharge paths, that is a path for dispersing thermoelectrons from the pole point B to F2, a path from the pole point A to F2, a path from the pole point D to F1 and a path from the pole point C to F1.

Thus, as the hot-cathode discharge lamp has four emission paths, it is possible to prevent heat from being generated intensively from one pole point of the filament, whereby an operation efficiency of the filament is improved and the lifetime thereof is also prolonged.

Figure 5:
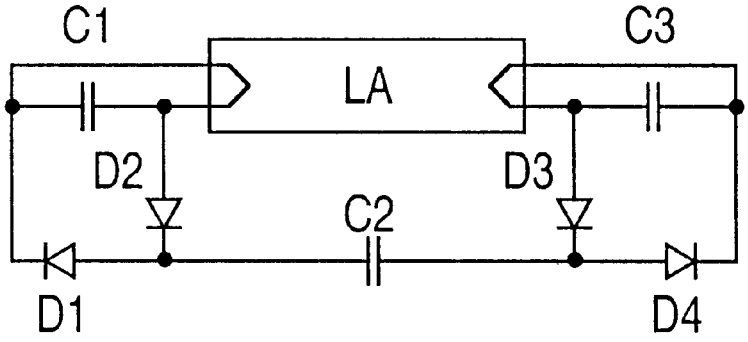
FIG. 5 is a diagram describing a circuit that operates in an equivalent manner to the lamp operating circuit described in FIG. 4.
Figure 6:
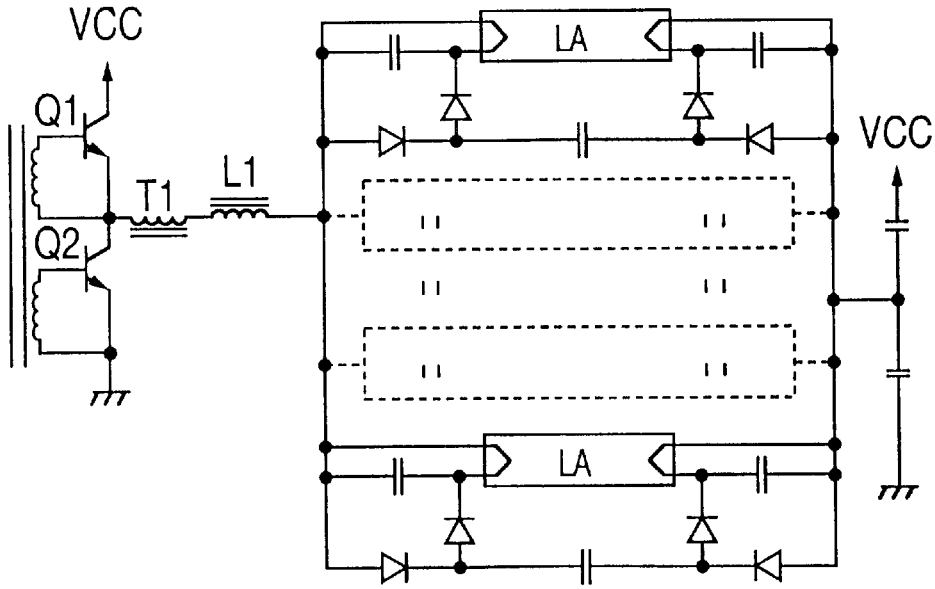
FIG. 6 is a diagram describing an example where two or more lamp operating circuits indicated in FIG. 4 are connected in parallel.
Figure 7:
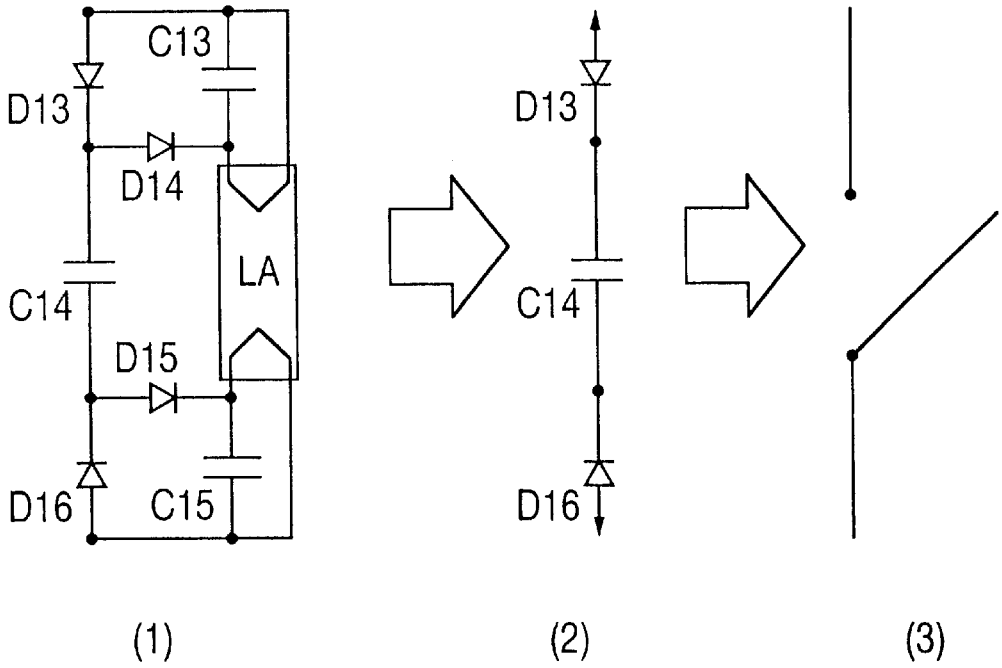
FIG. 7 is a circuit diagram for explaining an operation of the lamp operating circuit indicated in FIG. 4.

If the hot-cathode discharge lamp LA is removed from the lamp operating circuit in FIG. 4, the equivalent circuit indicated in FIG. 7 is obtained. More specifically, the diode D14 supplies a direct-current voltage to the capacitor C13 in the series circuit consisting of the capacitor C13 and the diode D14. Given that XC=½πf, a value of the impedance XC becomes "infinity", whereby the series circuit becomes an open circuit in which practically no current flows. The series circuit consisting of the capacitor C15 and diode D15 also becomes an open circuit where no current flows. Further, as is clear from FIG. 7 (2), current does not flow in the circuit consisting of the diode D13, capacitor C14 and diode D16 because the diode D13 and diode D16 are connected to the ends of the capacitor C14 in the opposing directions. As is explained above, if the hot-cathode discharge lamp LA is removed from the lamp operating circuit in FIG. 4, the lamp operating circuit becomes an open circuit having an infinite impedance as is described in FIG. 7 (3). Thus, if two or more lamp operating circuits are connected in parallel as indicated in FIG. 6, removal of one of the hot-cathode discharge lamps connected to the respective lamp operating circuit will not affect the remaining lamp operating circuits. Even though the lamp operating circuit 4 in the present embodiment is connected in such a way as described in FIG. 5, it operates in an equivalent manner to the lamp operating circuit in FIG. 4.

If a normal operating current of the self-excitatory inverter flows to the primary side coil of the transformer TL2, that is TL2-F1 during an operation of the self-excitatory inverter, a voltage of about 3V is generated across the secondary side coils TL2-S1 and TL2-S2 of the transformer TL2, and is supplied to the bases of the transistors Q3 and Q4. On the other hand, a voltage of about 10V is generated across the TL2-S3 and is supplied to the thyristor SCR1 via the diode D3.

The thyristor SCR1 maintains the electrically off state where a resistance across an anode and cathode is high. When a trigger signal (TRIGGER) is applied to a gate of the thyristor SCR1 (GATE), the thyristor SCR1 enters an on state and the resistance across the anode and cathode drops as if the switch is turned on. Thus, a voltage across the anode and cathode becomes almost zero and the on state is maintained until the voltage is blocked. Therefore, the thyristor SCR1 is a silicone controlled rectifier.

Next, an operation of the overload protective circuit 6 in FIG. 3 will be explained. If an excess current flows in the lamp operating circuit 4 due to an expiration of a lifetime of the hot-cathode discharge lamp or a wrong connection, etc., a voltage induced to the secondary side coil TL3-S of the reactor TL3 in the self-excitatory inverter 3 goes up. When the voltage goes up, it is rectified by the rectifying diode D11 and the voltage charged to the capacitor C8 by the resistors R20 and R15 also goes up. When the voltage of the capacitor C8 goes up to a trigger voltage of DIAC 1, the DIAC 1 is triggered supplying a trigger signal to the gate of the thyristor SCR1, whereby the thyristor SCR1 is turned on. Once the thyristor SCR1 is turned on, a voltage of the secondary side coil TL2-S3 of the transformer TL2 goes down to 1~2V, which is an internal voltage of the diode D3 and thyristor SCR1. A voltage across TL2-S1 and TL2-S2 also declines to 0.1~0.3V at the same rate as that of TL2-S2 becomes lower than the operating point, whereby the transistors Q3 and Q4 stop operating. At the same time, the capacitor C10 also discharges via the series circuit consisting of the diode D1 and thyristor SCR1, so that it is not recharged and an operation of the actuating signal circuit 5 is also stopped. Further, the smoothing capacitor C3 in the booster circuit also discharges via the series circuit consisting of the diode D21 and thyristor SCR1. Thus, an operation of the booster circuit is also stopped and all the circuits stop operating, and as a result, they are protected.

Figure 9:
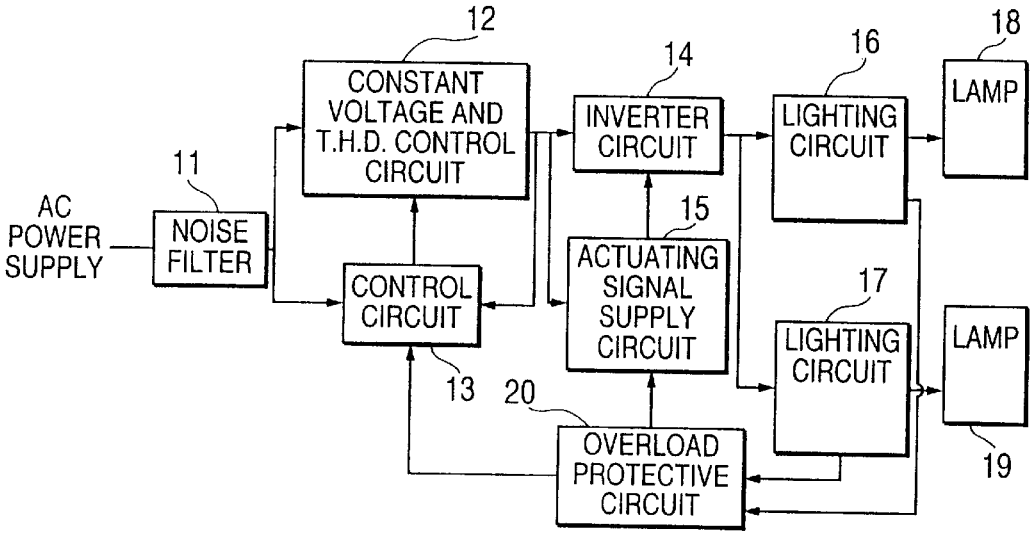
FIG. 9 is a schematic block diagram describing a discharge lamp operating electronic device according to another embodiment of the present invention.

FIG. 9 is a schematic block diagram describing a discharge lamp operating electronic device according to another embodiment of the present invention. In FIG. 9, the numeral 11 denotes a noise filter; 2 is a constant voltage and T.H.D. (Total Harmonic Distortion) control circuit; 13 is a control circuit; 14 is an inverter circuit; 15 is an actuating signal supply circuit; 16 and 17 are lamp lighting circuits; 18 and 19 are lamps; 20 is an overload protective circuit. Next, an operation of the device in FIG. 9 will be explained below. The noise filter 11 rectifies an alternating-current voltage from the AC power supply to supply a direct-current power to the constant voltage and T.H.D. control circuit 12 and control circuit 13. When the direct-current power is supplied to the constant voltage and T.H.D. control circuit 12 from the noise filter 11, the control circuit 12 supplies a low operating voltage to the inverter circuit 14 at the beginning of the supplying of the direct-current power to heat the filament of the discharge lamp. Then, for a predetermined period of time, the operating voltage supplied to the self-excitatory inverter is gradually increased to operate the discharge lamp at a low voltage. After the predetermined period of time has passed, a constant voltage is supplied to stabilized an operation of the inverter circuit 14. The actuating signal supply circuit 15 operates at the beginning of the supplying of the direct-current power and supplied an actuating signal to the inverter circuit 14. After a cycle of an operation of the inverter circuit 14, the actuating signal supply circuit 15 stops supplying the actuating signal. The inverter circuit 14 converts the operating voltage supplied from the constant voltage and T.H.D. control circuit 12 to high frequency and sends it to the lamp lighting circuits 16 and 17. The lamp lighting circuits 16 and 17 convert the high-frequency output from the inverter circuit 14 into sine waves to operate the lamps 18 and 19. When an excess of current flows in the lamp operating circuits 16 and 17 due to an expiration of a lifetime of the hot-cathode discharge lamp or a wrong connection, etc., the overload protective circuit 20 outputs a signal to the actuating signal supply circuit 15 an stops an operation of the inverter circuit 14. In this case, the overload protective circuit 20 also outputs a signal to the control circuit 13 to thereby stop an operation of the constant voltage and T.H.D. control circuit 12.

INDUSTRIAL APPLICABILITY

As is explained above, according to the present invention, at the initial stage of power supply, the booster circuit for supplying operating power to the self-excitatory inverter supplies a low operating voltage to the self-excitatory inverter, thereby preheating the filament of the discharge lamp. By gradually raising the operating voltage of the self-excitatory inverter for a predetermined period of time, the discharge lamp is operated at a low voltage to thereby prolong the lifetime of the discharge lamp. After the predetermined period has passed, the booster circuit supplies the operating voltage as a constant voltage to the self-excitatory inverter to stabilize the operation of the self-excitatory inverter. When input power changes within ±20% due to changes in the commercial power, etc., a range of change in the output from the discharge lamp is maintained to be within ±3% so that a relationship between voltage and current in the discharge lamp becomes consistent. Thus, the lifetime of the discharge lamp is prolonged and a consistent illumination is provided.

Further, for solving the problem of the conventional discharge lamp operating device wherein thermal electrons are emitted intensively from a certain location on the filament and as a result, the temperature of the location substantially increases, shortening the lifetime of the discharge lamp, at least four emission path dispersing diodes are installed in the lamp operating circuit so that the filament of the discharge lamp emits thermal electrons alternately through four thermionic emission paths and, thereby, the operating efficiency of the filament is improved.

Further, since the transition from one thermionic emission path to another takes place linearly, no noise is generated. Since the filament heating voltage can be readily set by only two heating voltage adjusting capacitors, the operating efficiency of the discharge lamp is improved and the service life of the discharge lamp is prolonged, thereby maximizing energy conservation.

What is claimed is:

1. A discharge lamp operating device comprising:

a direct-current power supply for outputting direct-current power obtained by rectifying an alternating-current input voltage;

a booster circuit for converting the direct-current power provided by said direct-current power supply into a predetermined operating voltage;

a self-excitatory inverter for converting the predetermined operating voltage provided by said booster circuit into a predetermined high frequency signal; and a lamp operating circuit for converting the predetermined high-frequency signal from said self-excitatory inverter into sine waves to light a discharge lamp;

said lamp operating circuit comprising:

a hot-cathode discharge lamp having first and second filaments which face each other said first filament comprising first and second pole points and said second filament comprising third and fourth pole points, a resonant capacitor connected to said discharge lamp in parallel;

first and second thermionic emission path dispersing diodes which are connected in opposing directions between said resonant capacitor and said third and fourth pole points of said second filament in order to allow a first current provided by said self-excitatory inverter to flow to said first filament via said second thermionic emission path diode and said resonant capacitor and to prevent the first current from flowing to said second filament; and third and fourth thermionic emission path dispersing diodes which are connected in opposing directions between said resonant capacitor and said first and second pole points of said first filament in order to allow a second current provided by said self-excitatory inverter to flow to said second filament via said fourth thermionic emission path dispersing diode and said resonant capacitor and to prevent the second current from said self-excitatory inverter from flowing to said first filament.

2. The discharge lamp operating device as claimed in claim 1, wherein said booster circuit comprises:

a sensor for sensing a change in the direct-current power which varies in proportion to a change in the alternating-current input voltage; and a controller for adjusting the predetermined operating voltage supplied to said self-excitatory inverter on the basis of an output from said sensor for the predetermined operating voltage to be a constant voltage.

3. The discharge lamp operating device as claimed in claim 1, wherein said lamp operating circuit is designed such that a plurality of lamp operating circuits can be connected in parallel and when hot-cathode discharge lamps connected to said plurality of lamp operating circuits, respectively, are removed, each of said lamp operating circuits assume infinite impedance and as a result, said lamp operating circuits from which said hot-cathode discharge lamps were removed are separated from the circuit and, therefore, even when at least one of said hot-cathode discharge lamps connected in parallel is removed, the remaining hot-cathode discharge lamps can be operated.

4. The discharge lamp operating device as claimed in claim 1, wherein due to a phase difference of 90° between a voltage across said resonant capacitor and a current flowing in said resonant capacitor and operation of said first, second, third and fourth thermionic emission path dispersing diodes, four thermionic emission paths are formed in said hot-cathode discharge lamp, that is, a first emission path for dispensing thermoelectrons from said first pole point of said first filament to all of said second filament, a second emission path for dispersing thermoelectrons from said second pole point of said first filament to all of said second filament F2, a third emission path for dispersing thermoelectrons from said third pole point of said second filament to all of said first filament and a fourth emission path for dispersing thermoelectrons from said fourth pole point of said second filament to all of said first filament, and the thermoelectrons are emitted alternately through the aforementioned four emission paths during a cycle of an operation by said self-excitatory inverter for supplying the first current to said lamp operating circuit and subsequently supplying the second current to said lamp operating circuit.

5. The discharge lamp operating device as claimed in claim 1, further comprising at least one other lamp operating circuit electrically connected in parallel to said lamp operating circuit, said at least one other lamp operating circuit similar in design to said lamp operating circuit.

6. The discharge lamp operating device as claimed in claim 1, further comprising an actuating circuit electrically connected to said booster circuit and said self-excitatory circuit, said actuating circuit operable to trigger operation of said self-excitatory inverter.

7. The discharge lamp operating device as claimed in claim 6, further comprising an overload protection circuit electrically connected to said lamp operating circuit, said actuating circuit, said booster circuit and said self-excitatory circuit, said overload protection circuit operable to prevent the discharge lamp operating electronic device from overloading.

8. The discharge lamp operating device as claimed in claim 1, further comprising an overload protection circuit electrically connected to said lamp operating circuit, said booster circuit and said self-excitatory circuit, said overload protection circuit operable to prevent the discharge lamp operating electronic device from overloading.

9. A discharge lamp operating device comprising:

a direct-current power supply operable to rectify an alternating-current input voltage into direct-current power;

a booster circuit electrically connected to said direct-current power supply, said booster circuit operable to convert the direct-current power into a predetermined operating voltage;

a self-excitatory inverter electrically connected to said booster circuit, said self-excitatory inverter operable to convert the predetermined operating voltage into a predetermined high frequency signal; and a lamp operating circuit, electrically connected to said self-excitatory inverter, said lamp operating circuit operable to convert the predetermined high-frequency signal into sine waves to light a discharge lamp;

said lamp operating circuit comprising:

a hot-cathode discharge lamp having first and second filaments which face each other, said first filament comprising first and second pole points and said second filament comprising third and fourth pole points;

a resonant capacitor electrically connected in parallel to said hot-cathode discharge lamp;

first and second thermionic emission path dispersing diodes electrically connected in opposing directions between said resonant capacitor and said third and fourth pole points of said second filament in order to allow a first current provided by said self-excitatory inverter to flow to said first filament via said second thermionic emission path diode and said resonant capacitor and to prevent the first current from flowing to said second filament; and third and fourth thermionic emission path dispersing diodes which are electrically connected in opposing directions between said resonant capacitor and said first and second pole points of said first filament in order to allow a second current provided by said self-excitatory inverter to flow to said second filament via said fourth thermionic emission path dispersing diode and said resonant capacitor and to prevent the second current from said self-excitatory inverter from flowing to said first filament.

10. The discharge lamp operating electronic device as claimed in claim 9, wherein said booster circuit comprises:

a sensor operable to sense a change in the direct-current power which varies in proportion to a change in the alternating-current input voltage; and a controller electrically connected to said sensor, said controller operable to adjust the predetermined operating voltage supplied to said self-excitatory inverter to be a constant voltage on the basis of said sensor.

* * * * *

UNITED STATES PATENT AND TRADEMARK OFFICE

CERTIFICATE OF CORRECTION

PATENT NO. : 6,100,642

DATED : August 8, 2000

INVENTOR(S) : Jong Ki KIM

It is certified that error appears in the above-indentified patent and that said Letters Patent is hereby corrected as shown below:

In item 54, line 2, delete "ELECTRONIC".

Signed and Sealed this

Seventeenth Day of April, 2001

*Attest:*

Nicholas P. Godici

NICHOLAS P. GODICI

*Attesting Officer*

*Acting Director of the United States Patent and Trademark Office*